US005669078A

United States Patent [19]

Scremin et al.

[11] Patent Number: 5,669,078

[45] Date of Patent: Sep. 23, 1997

[54] SECURITY POCKET ASSEMBLY

[76] Inventors: Anthony J. Scremin, 12651 SW. 20 Ter., Miami, Fla. 33175; Tomiko Erickson, 10100 E. Calusa Club Dr., Miami, Fla. 33186

[21] Appl. No.: 488,155

[22] Filed: Jun. 7, 1995

Related U.S. Application Data

[63] Continuation-in-part of Ser. No. 206,967, Mar. 7, 1994, abandoned.

[51] Int. Cl.[6] ..... A41D 1/06; A41D 27/20

[52] U.S. Cl. ..... 2/247; 2/22; 2/79; 2/227; 2/275

[58] Field of Search ..... 2/22, 59, 79, 69, 2/69.8, 247, 248, 249, 250, 251, 252, 253, 254, 275, 269, 94, 105, 106, 108

*Primary Examiner*—Jeannette E. Chapman

*Attorney, Agent, or Firm*—Malloy & Malloy, P.A.

[57] ABSTRACT

A security pocket assembly for use in combination with a garment of the type having a pair of leg portions, each terminating in an open lower end, the pocket assembly including at least one material panel secured along an interior of at least one of the leg portions, near an open lower end of the leg portion, so as to define a compartment, the leg portion further including a slit disposed therein, the slit being positioned to correspond an open top edge of the material panel so as to provide access to an interior of the compartment from an exterior of the leg portion, while not being substantially visible from an exterior of the leg portion.

20 Claims, 2 Drawing Sheets

SECURITY POCKET ASSEMBLY

This is a continuation-in-part application of a currently patent application having Ser. No. 08/206,967, filed on Mar. 7, 1994, now abandoned.

BACKGROUND OF THE INVENTION

1. Field of the Invention

The present invention relates to a security pocket assembly to be used in combination with a garment of the type including a pair of leg portions, the security pocket facilitating secured and yet concealed carrying of various items in a comfortable, conveniently accessible location on the person of a user.

2. Description of the Related Art

It has long been a desire of many individuals to conceal personal items, especially money, on various hidden locations on their person such that the items will be protected, yet will be accessible to the user. In order to achieve this, individuals have turned to money belts, shoe pockets, interior waist pockets on their garments, or merely to placing the items to be concealed in their shoes or socks. Unfortunately, these hidden locations are well known, and more particularly are often very difficult to access when the user wishes to retrieve the items. For example, in the circumstance of money belts or interior waste pockets, a user must often remove or loosen a variety of garments before the concealed items are accessible. In the case of concealing money in shoes or socks, individuals are faced with the problem of the items shifting during movement so as to be relocated to an inaccessible location such as deep into an interior of the shoe or sock. Also, in the case of socks, they will tend to sag under the weight of the items, thereby potentially releasing the items. Accordingly, it would be highly beneficial to provide a security pocket assembly which provides a safely concealed location, yet which will also maintain the concealed items easily and conveniently accessible.

In addition to the referenced secret hiding locations generally used, there are also, numerous pocket assemblies such as those recited in the patents to Denman, U.S. Pat. No. 4,831,666 and Valtakari, U.S. Pat. No. 5,105,473, each of which discloses garments having a variety of additional pockets for the positioning of padding and the like, an adjustable hem as recited in Persico, et al., U.S. Pat. No. 2,856,609, a sock containing a compartment as recited in Woodson, et al., U.S. Pat. No. 5,157,791, and an ankle bag as recited in Knudsen, U.S. Pat. No. 4,461,030. These articles, however, do not provide a security pocket formed directly in a garment such as a pair of trousers, the security pocket being substantially hidden when viewing an exterior of the garment, conveniently disposed so as to not shift location or deform the garment, and quickly and conveniently accessible by a user from an exterior of the garment. The device of the present invention is adapted specifically to meet these and various other needs present in the art.

SUMMARY OF THE INVENTION

The present invention is directed towards a security pocket assembly. The security pocket assembly is adapted for use in combination with a garment of the type which includes a pair of leg portions, and wherein each of the leg portions terminates in an open lower end. Included as part of the security pocket assembly is at least one, and preferably two material panels. The material panel is of the type including a top edge and at least two generally opposite side edges, and is secured to the garment so as to define a compartment. In accordance with the security pocket assembly of this invention, the material panel is secured to an interior of at least one of the leg portions near the open lower end thereof. In one embodiment, the lower leg portion of the garment includes a slit, wherein the material panel forming the security pocket will be secured. The slit is positioned to correspond a top edge of the material panel, thereby providing access to an interior of the compartment from an exterior of the leg portion. The compartment is sewn to an inboard vertical seamline of the leg portion, so as to substantially conceal the presence of the pocket from view. The security pocket of this invention will preferably include closure means for the compartment which may be in the form of a zipper. In a preferred embodiment, the compartment and closure means will be secured within the leg portion in a manner which will not cause puckering nor an un-evenness of the garment material which would render it observable. This may be accomplished by first severing and separating a lower leg portion from the main leg portion and then securing the security pocket between the severed edges thereof before re-attaching the lower leg portion to the main leg portion. In either embodiment, an important feature of the invention is that the material panel is secured by way of sewing stitches extending substantially across a main face thereof to the inboard vertical seam of the garment so that both the additional stitching will blend in with the stitching already on the garment and the compartment will be less moveable while in use. Finally, the security pocket of this invention may also include disguise means to further conceal the presence and location of the security pocket within the leg portion of the pants.

A primary object of the present invention is to provide a security pocket assembly which is substantially hidden from view.

A feature of the present invention is to secure the security pocket assembly within an interior of the leg portion of a garment near an open lower end thereof and along the inboard seam of the leg portion, corresponding the wearer's leg on an inner side thereof.

An feature of the present invention is to secure the security pocket assembly within the leg portion of the garment so that when the garment is observed on a wearer, the additional stitching is virtually unnoticeable, and thus the presence of the security pocket itself is likely to be unnoticed.

Another primary object of the present invention is to provide a security pocket assembly within a garment which when filled with money, coins, keys and the like will not interfere with the wearer's movements while walking for example, nor cause chafing to the wearer while in use.

Yet another object of the present invention is to provide a security pocket assembly which will contain various items securely therein and which will sufficiently contain the items such that they will not be relocated during movement of the user.

An advantage of this invention is that because the security pocket assembly is secured substantially along its main panel face to the interior of a garment's leg portion the pocket is very secure and is less likely to move about while in use.

Still another object of the present invention is to provide a security pocket assembly which is quickly and easily accessible from an exterior of the garment in which it is used.

A further object of the present invention is to provide a security pocket assembly, which will not increase the strain on nor stress to the back of a user if the items contained therein are heavy.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
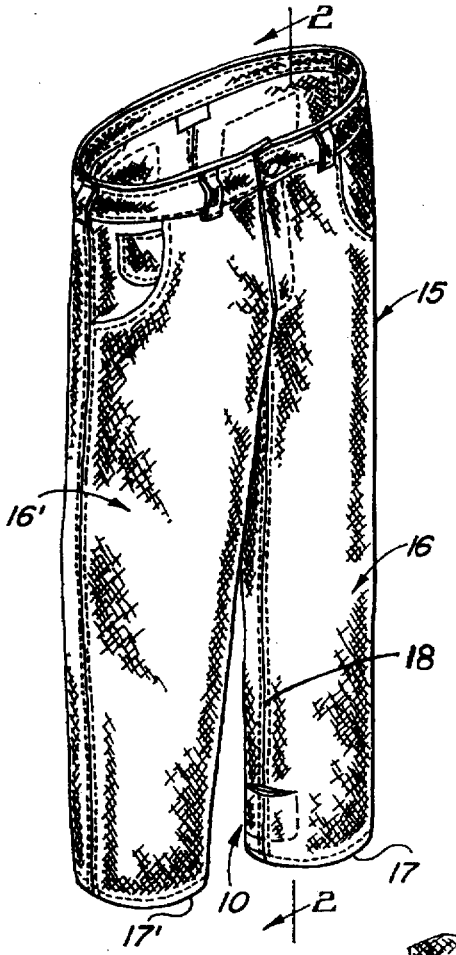
FIG. 1 is a front perspective view of the garment containing the security pocket therein.
Figure 2:
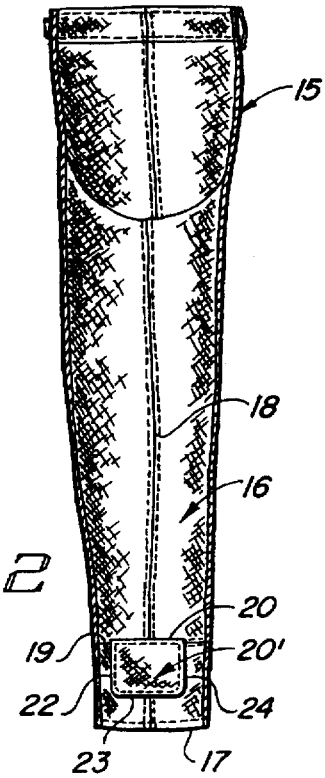
FIG. 2 is a side cross-sectional view along line 2—2 of FIG. 1.

Shown throughout FIGS. 1–6, the present invention is directed towards a security pocket assembly, generally indicated as 10. The security pocket assembly 10 is adapted for use in combination with a garment 15 of the type including a pair of leg portions 16 and 16'. Preferably, the leg portions 16 and 16' are elongate, and they terminate in open lower ends 17 and 17', such as in a pair of pants. Typically, each leg portion will contain two vertically extending seams, an outboard seam corresponding the outside leg area of a wearer and an inboard seam, 18 corresponding the inside leg area of a wearer, as illustrated in FIG. 2.

As shown in FIG. 1, the security pocket 10 is preferably disposed on an inside leg area of the leg portion 16 which confronts the second leg portion 16', thereby helping to conceal the presence and location of the security pocket assembly 10 when the wearer of the garment 15 is observed by another. Further, the security pocket 10 is preferably disposed on the inside leg area of the leg portion 16 near the lower open end 17 thereof. It will be appreciated that by positioning the security pocket 10 near the open lower end 17 of the leg portion, and preferably above a wearer's ankle region but below the wearer's knee, there is sufficient room within the pants' leg between the pocket and the wearer's leg such that when the pocket is filled with coins, keys, credit cards and the like, it will still be concealed within the pant leg portion instead of bulging outwardly. Additionally, in this preferred location the filled pocket will not contact a wearer's skin and thus, will not cause chafing of the skin and will not interfere with the wearer's movements. Finally, in this preferred location, the security pocket will enable the user to easily cross legs or wear boots.

Figure 3:
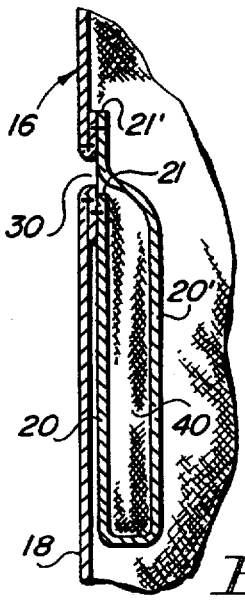
FIG. 3 is a side view of a preferred embodiment of the security pocket assembly.

Included as part of the security pocket assembly 10 is at least one material panel 20. The material panel 20, which can be formed of the same material as the garment 15 or of any other suitably strong yet soft material, includes a top edge 21, a bottom edge 23, and a pair of oppositely disposed side edges 22 and 24. This material panel can be folded over onto itself so as to form a compartment 40 or preferably, there will be two of the material panels 20 and 20', as shown in FIG. 3, which are secured to one another along the side edges 22, 24 and bottom edge 23 in order to define the compartment 40 therebetween. The compartment 40 is sized to contain a variety of items such as money, keys, identification and the like. Further, the compartment 40 is secured to the leg portion 16 in an interior thereof near its open lower end 17, thereby concealing the existence of the compartment 40 to any one viewing the person wearing the garment.

As shown in FIG. 3, the material panel 20 can be secured in many ways to the leg portion 16 of the garment. For example, the panel can be secured along its bottom edge 23 and side edges 22 and 24 directly to one of the leg portions 16 so as to define the compartment 40. It will be appreciated however, that the stitching used to secure the panel to the leg portion 16 in the manner Just described will be noticeable and possibly conspicuous as the leg portion of most garments typically contain no stitching except for the vertical outboard seam and the vertical inboard seam 18, shown in FIG. 2. Therefore, in the preferred embodiment of this invention the compartment 40 will be secured to a garment's leg portion substantially along the vertical inboard seam 18 in order to render unnoticeable, 4 the stitching needed to do so. Thus, in one embodiment and as shown in FIG. 3, the material panel 20 may be attached along its top edge 21 directly to the one pant leg portion 16 on the leg portion's interior side, and further, the portion of the panel which is adjacent the interior of the pant leg 16, may then be secured vertically along its main face 25 (shown in FIG. 4) to the inboard pant leg seam 18. It will thus be appreciated that in one preferred embodiment, the compartment 40 defined by material panels 20 and 20' is secured not only to the interior of the leg portion 16 so as to not be substantially visible along the exterior of the leg portion 16, but further, is secured to the interior of the leg portion 16 by way of a generally "T" shaped pattern or seam. This generally "T" shaped seam configuration runs horizontally, along the top edges of the material panel 20 and about the slit 30 as well as vertically, namely, substantially across main panel face 25 adjacent to and to correspond the vertical seamline 18 of the leg portion 16. It will be appreciated by those skilled in the art that by securing most of the compartment to the inboard vertical seamline 18, the additional stitching needed for securing the panel is hardly noticeable. While other shaped, seam configurations could be utilized, the necessary stitching would not only be conspicuous but could also disfigure the look of the pant leg. Also, because the security pocket is secured to the inboard seam, the pocket assembly is very secure within the pant leg. Consequently, the security pocket is not likely to move much while in use with the added benefit that the contents (such as coins) will jiggle less and further, the pocket will be less likely to rupture. While the use of sewn stitches or seams are contemplated, the compartment 40 can alternatively be secured to the leg portion 16 by adhesives or other suitable fastening means which are now known or which may come to be known which will not be substantially visible from an exterior of the leg portion 16.

Figure 4:
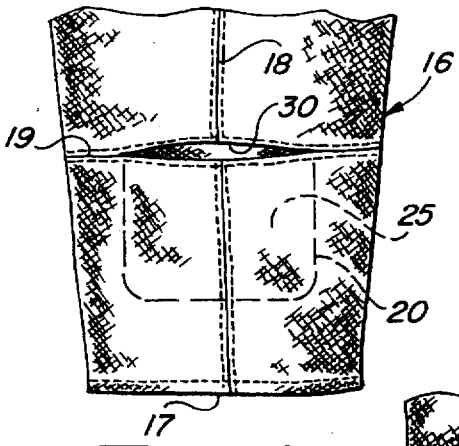
FIG. 4 is an isolated view of the preferred embodiment of the security pocket assembly shown in FIG. 3.
Figure 5:
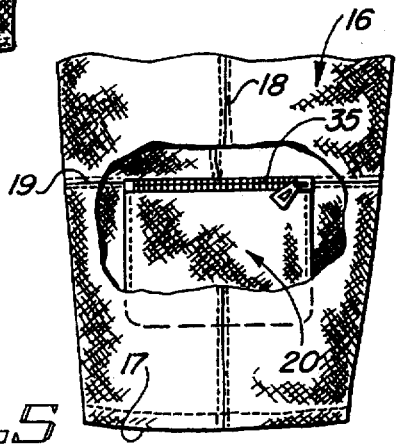
FIG. 5 is another embodiment of the security pocket assembly disposed within a garment.
Figure 6:
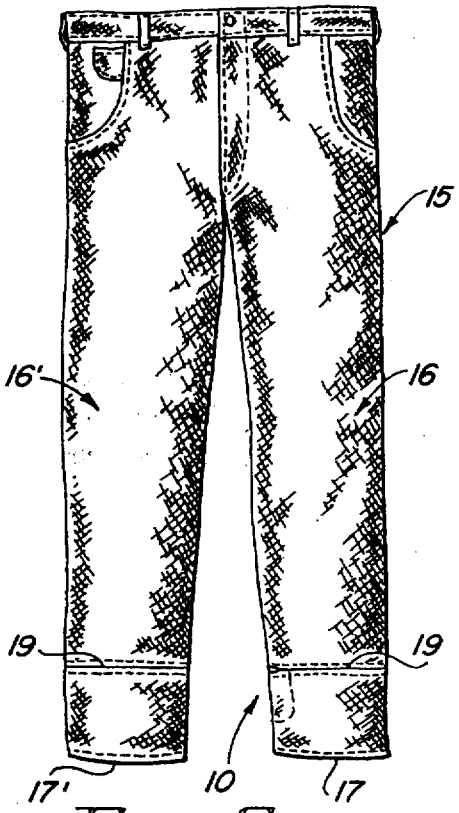
FIG. 6 is another embodiment of the security pocket assembly disposed within a garment having disguise means to conceal the existence of the security pocket assembly.

As shown in FIGS. 1 through 3, in one embodiment, a slit 30 is cut into the leg portion 16 containing the material panel 20. As best illustrated in FIG. 3, the slit 30 is disposed to correspond the top edges 21 and 21' of the compartment defined by the material panel 20, 20', thereby providing access to an interior of the compartment from the exterior of the leg portion 16. Specifically, the top edges 21, 21' of the material panel 20, 20' are attached to the slit 30, preferably by a conventionally known sewing stitch so as to be securely fastened to the slit 30. Preferably, the slit 30 is sized and disposed so as to blend with an exterior of the leg portion 16 and be substantially hidden from view from the exterior of the leg portion 16. However, in order to further conceal the slit 30, and accordingly the pocket assembly 10, disguise means may be employed. These disguise means can be in the form of a separate seam 19, as illustrated in FIG. 4, which extends about a periphery of the leg portion 16 such that the slit 30 only appears as part of the seam. It will be appreciated that seam 19 is intended to be merely ornamental and is not in the form of a cuff for the pants. Additionally however, any other fashion accessory or variance such as a cuff or patterned design could be utilized to conceal the slit 30. In order to further conceal the location of the security pocket assembly 10 within the garment 15, the disguise means such as the seam 19 may be disposed on both leg portions 16 and 16' as seen in FIG. 6. Also, both leg portions 16 and 16' could be adapted with a pocket assembly 10.

As a further means of security, a closure means for the security pocket may be provided to substantially close the slit 30 and corresponding top pocket edges 21 of the pocket assembly. The closure means will be operably connected to the leg portions along both sides of slit 30 and may be in the form of conventional hook and look type fasteners. It will be appreciated that other fasteners can be used to maintain the security pocket 10 in a closed orientation, such as mating snaps and possibly buttons, so long as the security pocket remains substantially hidden from view. Thus, even a zipper 35 may be disposed along the top edges 21 of the material panels 20 and 20' in order to close the slit 30 and also to further secure an interior of the pocket assembly 10.

Figure 7:
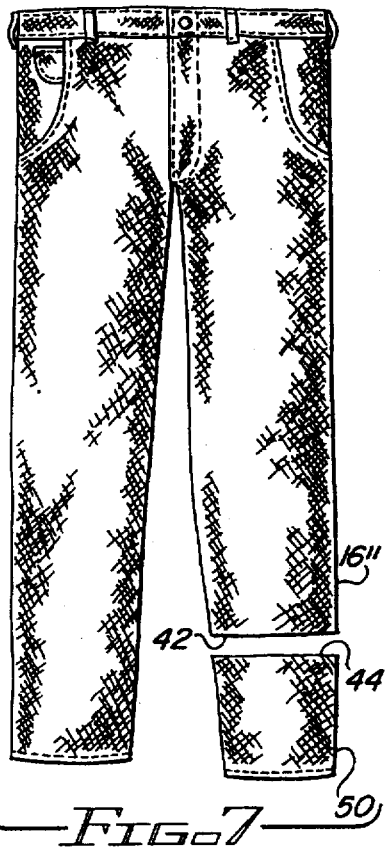
FIG. 7 is a front perspective view of a garment having leg portions wherein a lower portion of one leg portion has been cut away from the main leg portion.
Figure 11:
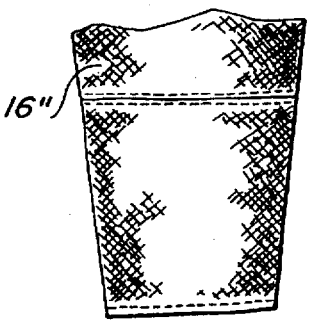
FIG. 11 is an isolated view of a re-attached lower and main leg portion which include a preferred embodiment of this invention and which illustrate disguise means thereon in the form of two additional seams.
Figure 8:
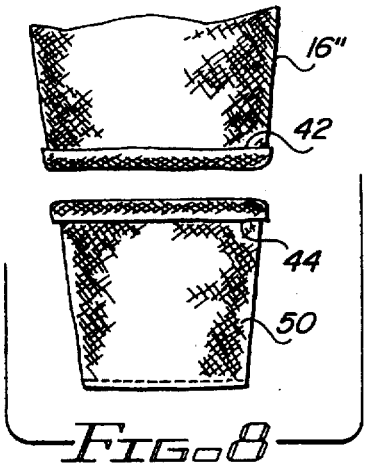
FIG. 8 is an isolated view of the main leg portion and severed lower leg portion illustrated in FIG. 7 and showing the respective edges thereof folded back.
Figure 9:
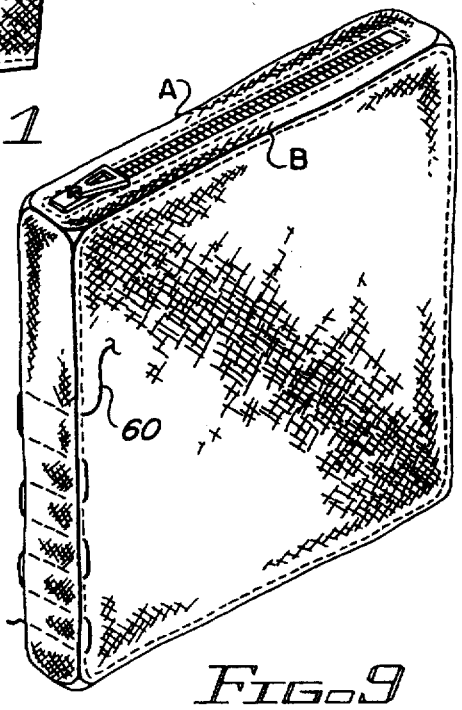
FIG. 9 is an isolated view of another embodiment of this invention wherein zipper closure means are secured to the security pocket compartment of the invention.
Figure 10:
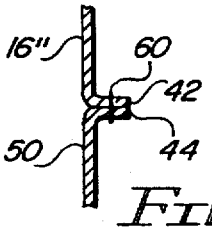
FIG. 10 is an isolated view of the main leg portion and severed lower leg portion illustrated in FIG. 8 and showing the respective edges thereof in position for being re-attached to each other.

However, it has been determined that in order to provide the security pocket with closure means, an alternative embodiment of the security pocket is more preferable. Specifically, when slit 30 is utilized with closure means it may result in a puckering of material about the slit. To avoid puckering, and because a zipper is a most preferred closure means, the security pocket assembly will be formed as illustrated in FIG. 7 wherein main leg portion 16 is completely cut away from lower end section 50 at the location where it is desired to secure the security pocket. Of course, lower end section 50 will be re-attached to leg portion 16 but before doing so, will be prepared for insertion of a zipper and the security pocket. Thus, and also to prevent fraying of the material at edges 42 and 44 which have now been formed in the leg portion 16, the edges are folded over onto the respective leg portion as shown in FIG. 8. A conventional zipper having two portions A and B is shown in FIG. 9, and each top edge of the material panel 20 (or of two such material panels as described previously) are sewn to one of the zipper portions A or B in order to form the security pocket. The zipper and pocket can then be disposed at the desired location between the leg portions 16", 50" and the leg portions may be re-attached by sewing them together with thread 60 as shown in FIG. 10, except of course along that part where the zipper is disposed. Either previous to or after the re-attachment of leg portions 16" and 50, the material panel 25 nearest the inner side of leg portion 50 is sewn to the vertical inboard seam of the leg portion substantially across the face of the panel, as has been described, and zipper portions A and B are sewn to the respective leg portions. If desired, folded ends 42 and 44 may also be sewn to the leg portions 16" and 50 respectively, including over the area where the zipper and top panel edges have been secured, in order to prevent fraying and if so, preferably a thread color and stitch would be utilized which matches that of the garment. In this way, the overall garment has a smooth, finished and yet custom designed look, as shown in FIG. 11 and more importantly, acts to almost completely conceal the security pocket assembly located within the leg portions. Of course, it will be appreciated that by forming the security pocket assembly in the above described manner, the resulting leg portion 16" will be slightly shorter than the other leg portion and even though the assembly is operable, this may not be desirable to the wearer. Thus, in order to offer a finished look and also hide the presence of a security pocket, each of the two leg portions will be altered and provided with a security pocket assembly as described in this paragraph.

Since modifications, variations and changes in detail can be made to the described preferred embodiment of the invention, it is intended that all matters in the foregoing description and shown in the accompanying drawings be interpreted as illustrative and within the scope and spirit of this invention, and not in a limiting sense. Thus, the scope of the invention should be determined by the appended claims and their legal equivalents.

Now that the invention has been described,

What is claimed is:

1. In combination with a garment of the type including a first leg portion and a second leg portion, each of the leg portions terminating in an open lower end and having an inboard vertical seamline; a security pocket assembly comprising:

at least one material panel having a first top edge, a second bottom edge and at least two generally opposite side edges, said material panel being folded to define a compartment wherein said first top edge generally corresponds with said second bottom edge, said compartment being secured in an interior of at least one of the leg portions near the open lower end of said leg portion;

a slit in said at least one leg portion, said slit having a first and a second opposing lip, said slit being disposed to correspond said corresponded top and bottom edges of said material panel so as to provide access to an interior of said compartment from an exterior of the leg portion, and said material panel being secured in said at least one leg portion by a generally T shaped pattern, said T shaped pattern securing said first top edge of said panel to said first opposing lip of said slit and Securing said second bottom edge of said panel to said second opposing lip of said slit, and further securing a main face of said panel adjacent the inboard vertical seamline to the inboard vertical seamline of said at lease one leg portion of the garment.

2. An assembly as recited in claim 1 further including disguise means structured and disposed to hide and conceal said slit in the leg portion such that a location of said compartment is not easily ascertainable.

3. An assembly as recited in claim 2 wherein said disguise means includes a seam disposed along said slit about a periphery of the leg portion so as to conceal said slit.

4. An assembly as recited in claim 3 including one of said compartments in one of the leg portions, a second of the leg portions including said disguise means thereon so as to provide a balanced appearance and further conceal the location and presence of said slit in the leg portions.

5. An assembly as recited in claim 1 including two of said compartments, one of said compartments being disposed in each of the leg portions.

6. An assembly as recited in claim 1 including closure means disposed at said top edge of said compartment so as to close said compartment.

7. An assembly as recited in claim 6 wherein said closure means includes a zipper.

8. In combination with a garment of the type including a first leg portion and a second leg portion, each of the leg portions terminating in an open lower end and having an inboard vertical seamline; a security pocket assembly comprising:

at least two material panels, each panel having a top edge, a bottom edge and at least two generally opposite side edges, each of said material panels being secured to one another along said side edges and said bottom edges so as to define a compartment, said compartment being secured in an interior of at least one of the leg portions near the open lower end of said leg portion;

a slit in said at least one leg portion, said slit having a first and a second opposing lip, said slit being disposed to correspond said top edges of said compartment so as to provide access to an interior of said compartment from an exterior of the leg portion, and said material panel being secured within said at least one leg portion by a generally T shaped pattern, said T shaped pattern securing one of said top panel edges to said first opposing lip of said slit and securing another of said top panel edges to said second opposing lip of said slit, and further securing a main face of at least one of said panels to the inboard vertical seamline of said at lease one leg portion of the garment.

9. An assembly as recited in claim 8 further including disguise means structured and disposed to hide and conceal said slit in the leg portion such that a location of said compartment is not easily ascertainable.

10. An assembly as recited in claim 9 wherein said disguise means includes a seam disposed along said slit about a periphery of the leg portion so as to conceal said slit.

11. An assembly as recited in claim 10 wherein a second of the leg portions includes said disguise means thereon so as to provide a balanced appearance and to further conceal the location and presence of said slit in said at least one leg portion.

12. An assembly as recited in claim 8 including two of said compartments, one of said compartments being disposed in each of the leg portions.

13. An assembly as recited in claim 8 including closure means disposed at said top edge of said compartment so as to close said compartment.

14. An assembly as recited in claim 13 wherein said closure means includes a zipper.

15. In combination with a garment of the type including a first leg portion and a second leg portion, each of the leg portions terminating in an open lower end and having an inboard vertical seamline, wherein a lower leg portion has been severed from one of said leg portions, a security pocket assembly comprising:

at least two material panels, each panel having a top edge, a bottom edge and at least two generally opposite side edges, each of said material panels being secured to one another along said side edges and said bottom edges so as to define a compartment, zipper closure means having a first portion and a second portion; said first zipper portion being secured to one of said top panel edges and said second zipper portion being secured to another of said top panel edges, said compartment and zipper closure means being secured to the severed lower leg portion near one of said top panel edges and being secured to the severed main leg portion near another of said top panel edges, said compartment and zipper closure means being further secured to said at least one leg portion by a generally "T" shaped seam comprised of stitches sewn substantially across a main face of one of said compartment panels and secured to the inboard vertical seamline of said at least one leg portion of the garment, and said compartment and zipper closure means being disposed within an interior of said at least one leg portion of said garment upon the severed lower leg portion being re-sewn to the severed main leg portion.

16. In combination with a garment of the type including a first leg portion and a second leg portion, each of the leg portions terminating in an open lower end and having an inboard vertical seamline, wherein an end zone of the first leg portion has been severed therefrom, a security pocket assembly comprising:

at least two material panels, each panel having a top edge, a bottom edge, and at least two generally opposite side edges, each of said material panels being secured to one another along said side edges and said bottom edges so as to define a compartment, closure means secured to said top panel edges for closing said compartment, the severed end zone of the leg portion being re-attached to the main leg portion of the garment with said compartment and said closure means secured thereto and disposed within an interior of the leg portion of the garment, and one of said material panels forming said compartment being further secured to the inboard vertical seamline of the first leg portion of the garment.

17. An assembly as recited in claim 16 further comprising disguise means on the second leg portion, said disguise means structured and disposed to disguise and conceal said compartment on the first leg portion.

18. An assembly as recited in claim 16 wherein said closure means comprise a zipper.

19. In combination with a garment of the type including a first leg portion and a second leg portion, each of the leg portions terminating in an open lower end and having an inboard vertical seamline, wherein a lower leg portion has been severed from one of said leg portions, a security pocket assembly comprising:

a material panel having a top edge, a bottom edge, and at least two generally opposite side edges, said material panel being folded so as to define a compartment with said top edge generally corresponding said bottom edge and said side edges being secured together, closure means secured to said top and bottom panel edges for closing said compartment, the severed lower leg portion being re-attached to the main leg portion of the garment with said compartment and closure means secured thereto, and with said compartment and closure means disposed within an interior of the leg portion of the garment, and a main face of said panel forming said compartment being further secured to the inboard vertical seamline of the leg portion of the garment.

20. An assembly as recited in claim 19 further comprising disguise means on the second leg portion, said disguise means structured and disposed to disguise and conceal said compartment on the first leg portion.

* * * * *